United States Patent [19]

Poling

[11] Patent Number: 4,794,843

[45] Date of Patent: Jan. 3, 1989

[54] HYDRAULIC VALVE FOR CONTROLLING SINGLE-ACTING CYLINDER

[76] Inventor: Denzil C. Poling, Rte. 6, P.O. Box 80, Hagerstown, Md. 21740

[21] Appl. No.: 911,065

[22] Filed: Sep. 24, 1986

[51] Int. Cl.[4] ..... F15B 13/02; F01L 31/00

[52] U.S. Cl. ..... 91/47; 91/275; 91/277; 91/350; 91/410; 91/443; 137/625.17; 137/861; 251/65; 251/75

[58] Field of Search ..... 91/47, 275, 277, 350, 91/410, 443, 453, 459; 137/625.17, 625.69, 861; 251/65, 75

[56] References Cited

U.S. PATENT DOCUMENTS

| | | | |
|---|---|---|---|
| 748,928 | 1/1904 | Carlson | 91/350 X |
| 1,606,355 | 11/1926 | Fisher | 251/75 X |
| 1,747,899 | 2/1930 | Hogg . | |
| 2,496,036 | 1/1950 | Christensen | 251/76 |
| 2,906,492 | 9/1959 | Conrad | 251/325 |
| 2,960,971 | 11/1960 | Tear | 91/275 |
| 2,996,079 | 8/1961 | Mahand et al. | 91/47 |
| 3,269,412 | 8/1966 | Badke | 137/625.17 |
| 3,299,826 | 1/1967 | Williams | 91/275 X |
| 3,472,281 | 10/1969 | Chiba et al. | 137/625.69 |
| 3,532,121 | 10/1970 | Sturman et al. | 251/65 X |
| 3,847,371 | 11/1974 | Norton et al. | 91/275 X |
| 4,022,425 | 5/1977 | Govzman et al. | 251/324 |
| 4,367,763 | 1/1983 | Brand | 137/106 |

FOREIGN PATENT DOCUMENTS

| | | | |
|---|---|---|---|
| 281472 | 8/1927 | United Kingdom | 91/410 |

OTHER PUBLICATIONS

Parker Fluidpower, *Industrial Hydraulic Technology,* 1/85, pp. 8–2.

*Primary Examiner*—Robert E. Garrett
*Assistant Examiner*—Mark A. Williamson
*Attorney, Agent, or Firm*—Bernard, Rothwell & Brown

[57] ABSTRACT

A hydraulic control valve for a single-acting cylinder includes a valve housing having a cylindrical valve bore. A supply port present in the valve housing is in communication with the valve bore, as is a discharge port and a delivery port. A valve pin is slidable within the valve bore between first and second pin positions, the valve pin including a pin groove positionable to establish communication at the first pin position between the supply port and the delivery port to the exclusion of the discharge port. The pin is slidable from the first position to the second position to establish simultaneous communication with the pin groove between the supply port, the discharge port and the delivery port.

21 Claims, 3 Drawing Sheets

HYDRAULIC VALVE FOR CONTROLLING SINGLE-ACTING CYLINDER

BACKGROUND OF THE INVENTION

1. Field of the Invention

The present invention relates to a hydraulic valve for controlling a single-acting cylinder.

2. Description of the Background Art

Numerous hydraulic control valves having a variety of uses are known in the prior art. For example, expired U.S. Pat. No. 1,747,899 to Hogg discloses a coal pusher for locomotive tenders including a reciprocating pin valve, the valve pin having a single pin groove for shifting fluid flow between three ports and including a passageway through the center of the pin feeding a fourth valve port for operation of a double-acting cylinder.

Expired U.S. Pat. No. 2,906,492 to Conrad discloses a valve including a reciprocating pin having a single pin groove for providing communication between an outlet port and either of an exhaust port or an intake port.

Other valves having grooved pins are shown in U.S. Pat. Nos. 2,496,036; 3,472,281; 4,022,425 and 4,367,763.

Heretofore, none of the known prior art hydraulic valves have provided for automatic reciprocation of a single-acting cylinder in the absence of electrical devices or like shifting means. Accordingly, there remains a need in the art for a reliable and relatively inexpensive hydraulic control valve which is capable of providing for automatic reciprocation of the cylinder rod of a single-acting cylinder.

SUMMARY OF THE INVENTION

In accordance with the present invention, a hydraulic control valve includes a valve housing having a cylindrical valve bore, the valve housing further supply port, a discharge port and a delivery port, all in communication with the valve bore. The hydraulic control valve further includes a valve pin slidable within the valve bore between first and second pin positions. The valve pin includes a pin groove positionable to establish communication at the first pin position between the supply port and the delivery port to the exclusion of the discharge port. The pin is slidable from the first position to the second position to establish simultaneous communication between the supply port, the discharge port and the delivery port.

BRIEF DESCRIPTION OF THE PREFERRED EMBODIMENTS

Figure 2:
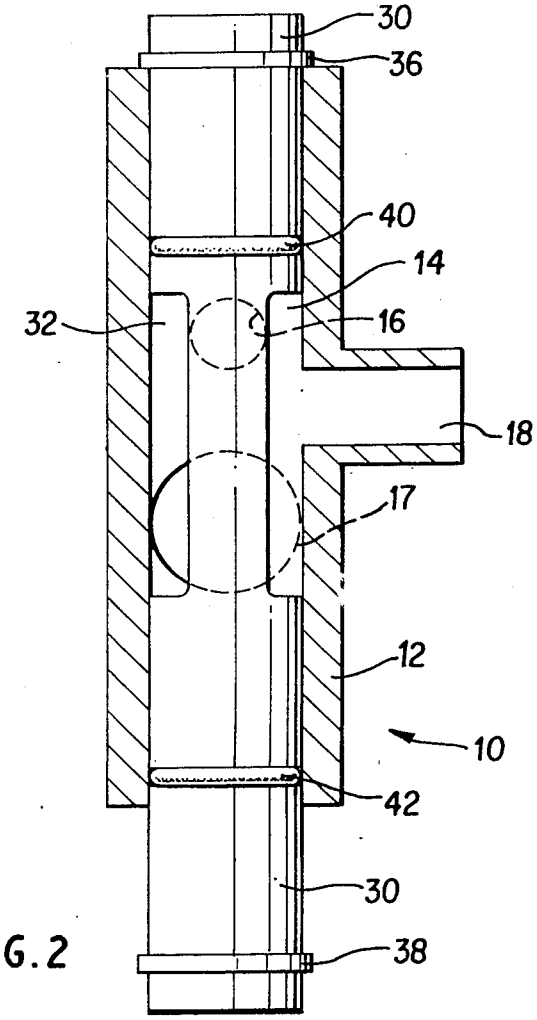
FIG. 2 is a sectional view of the hydraulic control valve of FIG. 1, positioned for allowing retraction of a hydraulic cylinder rod of a single-acting hydraulic cylinder.

With reference to FIGS. 1–4, a hydraulic control valve 10 includes a valve housing 12 having a cylindrical valve bore 14. In communication with valve bore 14 are a supply port 16 and a discharge port 17. Also in communication with valve bore 14 is a delivery port 18.

A valve pin 30 is slidable within valve bore 14. Valve pin 30 includes a pin groove 32 which, in the position shown in FIG. 1, establishes communication between supply port 16 and delivery port 18 to the exclusion of discharge port 17.

Suitable means, such as C-shaped locking rings 36 and 38 fitting into corresponding grooves on valve pin 30, prevent the slidable valve pin from inadvertently passing outside of valve housing 12. Rubber O-rings 40 and 42 provide seals between slidable valve pin 30 and housing 12.

Figure 1:
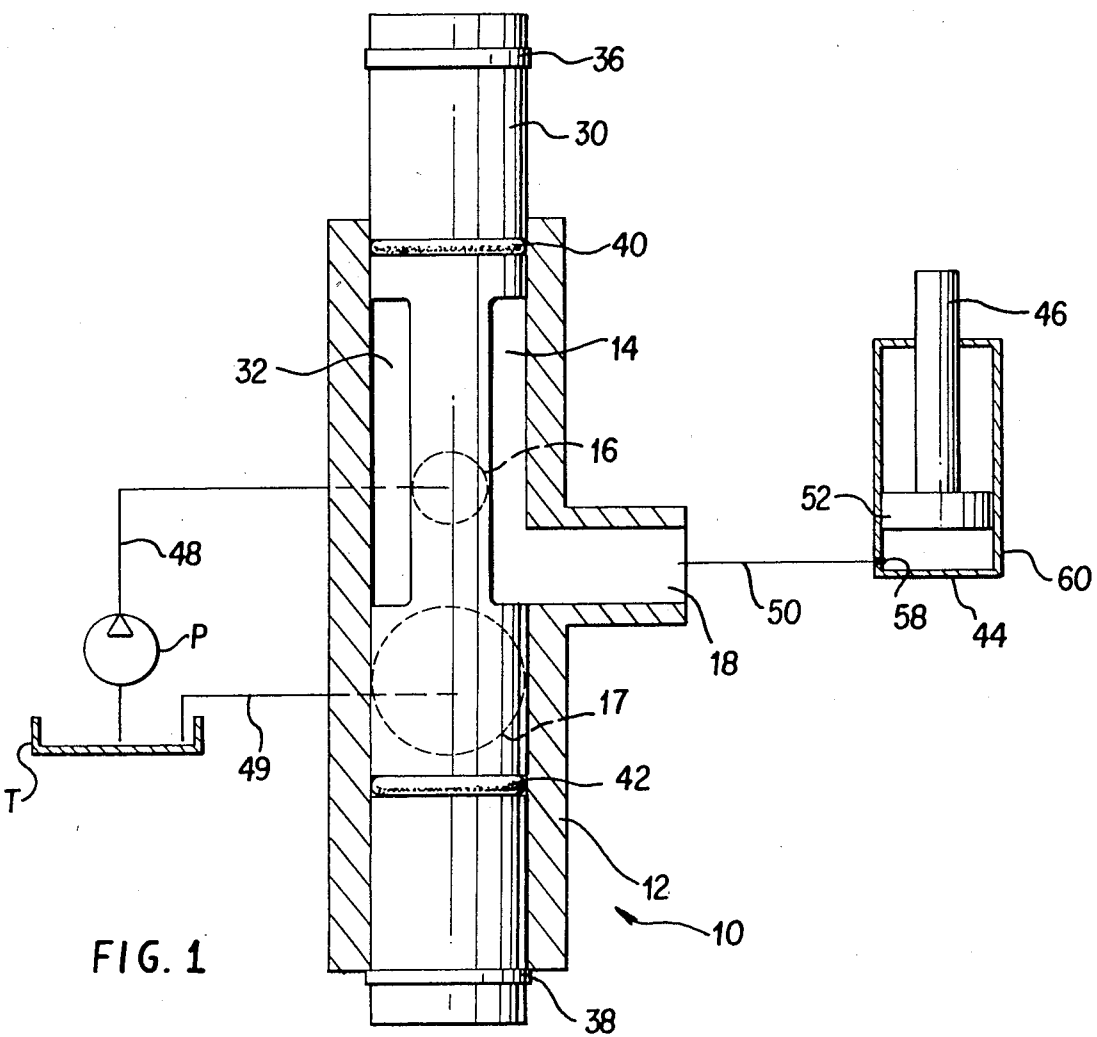
FIG. 1 is a sectional view, partly schematic, of a hydraulic control valve according to the invention connected to hydraulic pump and sump means as well as a single-acting hydraulic cylinder, the valve being in position for extension of the hydraulic cylinder rod.
Figure 3:
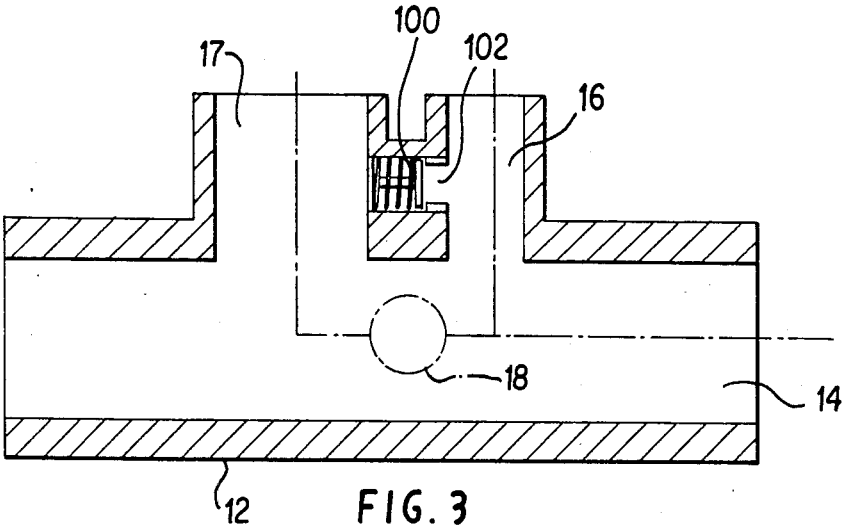
FIG. 3 is a sectional view of the valve housing of a valve according to the present invention with the valve pin removed.
Figure 4:
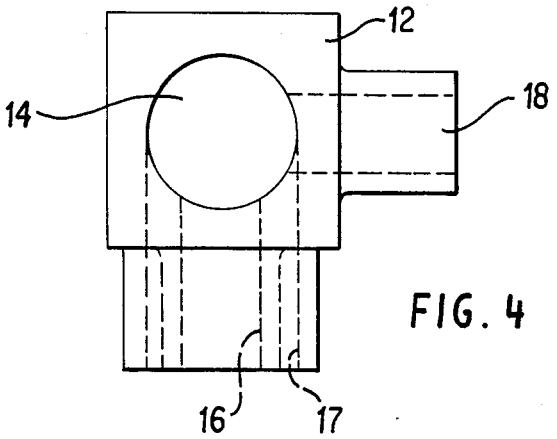
FIG. 4 is an end elevation view of the valve housing of FIG. 3.

FIG. 1 illustrates a valve according to the present invention operably connected to a single-acting hydraulic cylinder 44, as well as to a hydraulic pump P and hydraulic sump tank T. Delivery port 18 of valve 10 is connected to blind end drive cylinder port 58 of hydraulic drive cylinder housing 60 within which operates the hydraulically extendable reciprocating piston 52 controlling reciprocation of cylinder rod 46.

In the embodiment shown in FIG. 1, slidable pin 30 is positioned within valve 10 for extension of cylinder rod 46 by application of fluid pressure from pump P through line 48, valve supply port 16, pin groove 32, valve delivery port 18, line 50 and blind end cylinder port 58 to hydraulic cylinder 44 for the application of fluid pressure to piston 52 connected to piston rod 46.

FIG. 2 shows the position of slidable pin 30 within valve 10 for allowing retraction of a cylinder rod in a single-acting cylinder. In this position, there is simultaneous communication between supply port 16, discharge port 18 and delivery port 17, allowing cylinder 52 to fall, e.g., under the influence of gravity, for retraction of cylinder rod 46. Hydraulic fluid is pumped into valve supply port 16 through valve pin groove 32, and out of the valve through valve discharge port 17 to sump tank T for recycling while hydraulic fluid passes from cylinder 44 through blind end cylinder port 58 through valve delivery port 18 and valve discharge port 17 to the sump tank T via line 49 for recycling.

According to one embodiment, cross-sectional area of discharge port 17 is at least as large as the combined cross-sectional areas of port 16 and 18.

For automatic reciprocation of a single-acting cylinder, means are provided for connecting the cylinder rod 46 and the slidable valve pin 30 at predetermined cylinder rod extension and retraction positions. The rod and pin connecting means are capable of sliding the valve pin within the valve bore at predetermined extension and retraction positions to shift the valve pin between the positions shown in FIGS. 1 and 2, and thereby reverse direction of travel of a cylinder rod. A rod and pin connecting member provides means for reciprocating the pin, and is successively actuatable by respective extension and retraction of rod 46.

Figure 5:
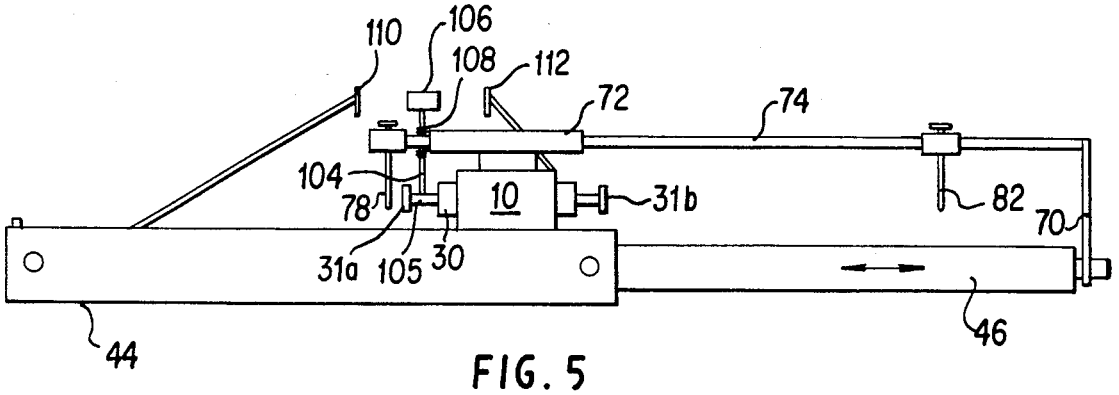
FIG. 5 is a schematic view showing a valve according to the invention with automatic valve control means for extension and retraction of a hydraulic cylinder rod.

In the embodiment shown in FIG. 5, a hydraulic valve 10 according to the invention is mounted on a single-acting hydraulic cylinder for cooperation with a rod and pin connecting member 74. As can be seen in FIGS. 1 and 5, the ends of pin 30 extend from opposite ends of housing 12, and include pin extension portions 31*a* and 31*b* providing means for reciprocating the pin 30 within the valve bore. The pin extensions 31*a* and 31*b* of pin 30 are adapted for connecting to cylinder rod 46 by means including rod and pin connecting member 74.

As shown in FIG. 5, the cylinder rod reversing means includes a tab 70 extending laterally from cylinder rod 46, and connecting the cylinder rod 46 with rod and pin connecting member 74. Rod and pin connecting member 74 is slidable in the same direction as cylinder rod 46, within guide tube 72 or other suitable means supported in the vicinity of valve housing 12. During extension of cylinder rod 46, tab 70 is moved in the same direction as rod 46. A pin contacting fence 78 is provided at an opposite end of rod and pin connecting member 74 from tab 70. Movement of tab 70 brought about by extension of cylinder rod 46 results in corresponding movement of pin fence 78 against pin extension 31*a* causing the valve pin 30 to slide within the valve bore from the position shown in FIG. 1 to the position shown in FIG. 2 and thereby allow reversal of the direction of travel of the rod for rod retraction.

The rod and pin connecting member 74 is provided with a second pin contacting fence member 82 for effecting reversal of cylinder rod direction upon retraction of the cylinder rod to a predetermined position. The second pin contacting member 82 extends from rod and pin connecting member 74 in position to contact pin extension 31*b* upon retraction of the rod to a predetermined position. Retraction of cylinder rod 46 causes the second pin fence member 82 to contact pin extension 31*b* and slide pin 30 within the valve bore to the position shown in FIG. 1, establishing communication between supply port 16 and delivery port 18 to the exclusion of discharge port 17.

Advantageously, the first and second pin fence members 78 and 82 are selectively positionable for contact with pin extensions 31*a* and 31*b* to permit manual or automatic control of valve 10. According to this embodiment, the fences can be moved out of the path of the pin extension portions, permitting manual operation of the valve for extension and retraction of a cylinder rod if automatic reversal of the cylinder rod is not desired. Any suitable means can be utilized for selective positioning of fences 78 and 82, including locking screws, pressure actuated clamps, hinges, and the like.

In the embodiment shown in FIG. 5, magnetic means are provided to assist in automatic reciprocation of valve 10. According to this embodiment, a handle 104 extends between and connects a weighted magnet member 106 with rod portion 105 of pin extension 31*a*. Handle 104 includes a spring 108 allowing pivoting movement of magnet 106 with respect to the shaft of handle 104. Metal handle-receivers 110 and 112 are positioned on opposite sides of weighted handle 104, the metal handle-receivers 110 and 112, together with magnet 106, being arranged in a line which is parallel with the axis of the valve pin 30 and the cylinder 44.

The weighted magnet member 106 is magnetically attractable to respective handle-receivers 110 and 112 when brought into magnetically interacting proximity so that the weighted member 106 and respective handle-receivers form magnetically interacting pairs. The magnet 106 is movable between the handle-receivers 110 and 112 by sliding movement of pin 30 to bring the magnet 106 into magnetic interaction with one or the other of the handle-receivers 110 or 112 to kinetically assist sliding movement of pin 30 within the valve.

At the extremes of cylinder rod movement, magnet 106 is brought first into interacting proximity with and then contact with one of handle-receivers 110 and 112, and is held against the handle-receiver by magnetic force. Movement of handle 104 pulls against the magnetic force, bending spring 108 until the magnetic force is overcome, whereupon the heavy magnet 106 pivots towards and contacts the other handle-receiver with sufficient momentum to assist in sliding pin 30 within the valve. Magnet 106 then is held against the other handle-receiver by magnetic force until pulled away by return movement of handle 104.

Other means for storing potential energy and kinetically or inertially shifting the valve pin may be used, including friction and leverage devices.

The above-described embodiment provides a hydraulic valve which is relatively simple and inexpensive to manufacture yet provides for a reliable automatic reversing of a single-acting cylinder rod without electricity.

According to one embodiment, a pressure relief valve 100 is provided between supply port 16 and discharge port 17. See FIG. 3. Pressure relief valve 100 is disposed in a passageway 102 connecting supply port 16 and discharge port 17, and operates at a predetermined hydraulic pressure level to shunt hydraulic fluid from supply port 16 to discharge port 17 and to the sump tank.

Figure 6:
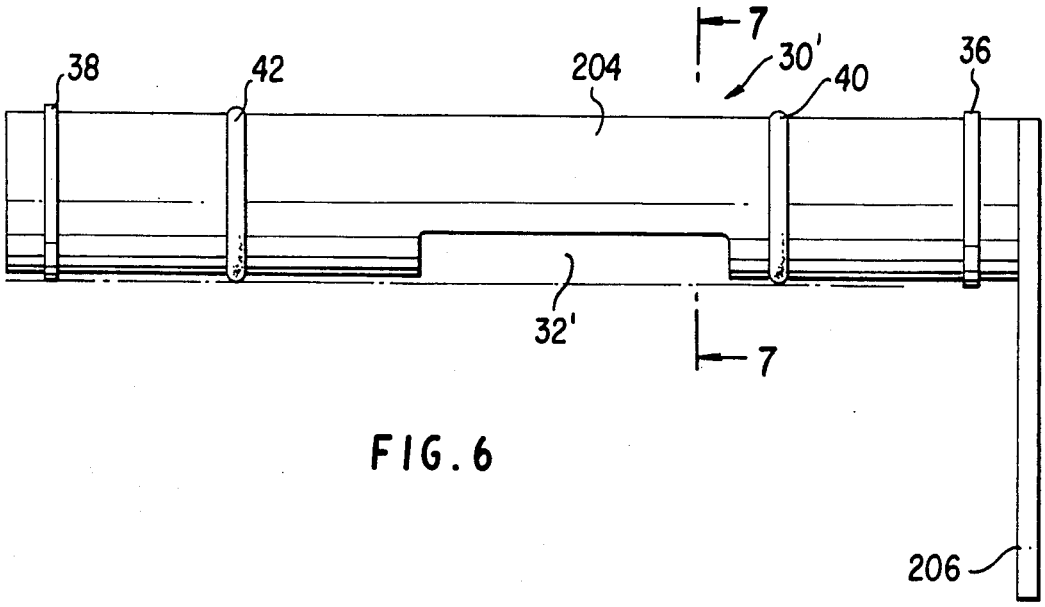
FIG. 6 is a side elevation view of an adjustable valve pin according to one embodiment.
Figure 7:
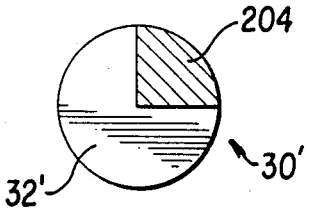
FIG. 7 is a cross-sectional view along line 7—7 of FIG. 6.

FIGS. 6 and 7 show a modified reciprocating valve pin 30' according to the present invention. According to this embodiment, pin groove 32' does not extend completely around the pin, but rather provides a pin surface control portion 204 along the periphery of the valve bore. Pin surface control portion 204 is rotatable with pin 30', e.g., by handle 206, to partially or fully block delivery port 18 and thereby cut off some or all of the flow of fluid to the cylinder to regulate the speed of or stop the piston. By rotating pin 30' to close port 18 with control portion 204, and sliding the pin from the position shown in FIG. 1 to the position shown in FIG. 2 to open discharge port 17, the piston rod will stop due to blockage of port 18 and hydraulic fluid will be delivered from port 16 to tank T via groove 32' and port 17.

The valve of the present invention is useful to many applications where it is desirable for automatic or manually regulated control of a single-acting cylinder. Such uses include raising a heavily weighted object to be dropped by gravity for post-driving, earth tamping, construction, demolition, forging tools and the like.

Since many modifications, variations and changes in detail may be made to the described embodiment, it is intended that all matter in the foregoing description and shown in the accompanying drawings be interpreted as illustrative and not in a limiting sense.

What is claimed is:

1. A hydraulic control valve comprising:

(a) a valve housing including a cylindrical valve bore, the valve housing further including a supply port in communication with the valve bore, a discharge port in communication with the valve bore, and a delivery port in communication with the valve bore;

the hydraulic control valve further comprising:

(b) a valve pin slidable within the valve bore between first and second pin positions, the valve pin including a pin groove, which pin groove is positionable to establish communication at the first pin position between the supply port and the delivery port to the exclusion of the discharge port, the pin being slidable from said first position to the second position to establish, through said pin groove, simultaneous communication between the supply port, the discharge port and the delivery port.

2. The hydraulic control valve of claim 1 further including means for reciprocating said pin within said valve bore between said first and said second positions, said reciprocating means being adapted for connecting to a drive cylinder having a hydraulically operable reciprocating piston therein, the piston controlling extension and retraction of a rod connected to the piston, said pin reciprocating means being successively actuatable by respective extension and retraction of said rod.

3. The hydraulic control valve of claim 2 further including means for rotating said pin within said bore, wherein said pin groove extends only partly around the periphery of the pin leaving a pin surface control portion, the pin being rotatable to block the delivery port with the pin surface control portion.

4. The hydraulic control valve of claim 3 wherein the pin is rotatable to partially block the delivery port with the pin surface control portion and thereby control fluid passage through the delivery port.

5. The hydraulic control valve of claim 4 further including a pressure relief valve positioned in a passageway connecting the supply port and the discharge port, the pressure relief valve being adapted to permit fluid flow from the supply port to the discharge port at a predetermined fluid pressure level.

6. The hydraulic control valve of claim 2 further including a pressure relief valve positioned in a passageway connecting the supply port and the discharge port, the pressure relief valve being adapted to permit fluid flow from the supply port to the discharge port at a predetermined fluid pressure level.

7. The hydraulic control valve of claim 3 further including a pressure relief valve positioned in a passageway connecting the supply port and the discharge port, the pressure relief valve being adapted to permit fluid flow from the supply port to the discharge port at a predetermined fluid pressure level.

8. The hydraulic control valve of claim 1 further including means for rotating said pin within said bore, wherein said pin groove extends only partly around the periphery of the pin leaving a pin surface control portion, the pin being rotatable to block the delivery port with the pin surface control portion.

9. The hydraulic control valve of claim 8 wherein the pin is rotatable to partially block the delivery port with the pin surface control portion and thereby control fluid passage through the delivery port.

10. The hydraulic control valve of claim 9 further including a pressure relief valve positioned in a passageway connecting the supply port and the discharge port, the pressure relief valve being adapted to permit fluid flow from the supply port to the discharge port at a predetermined fluid pressure level.

11. The hydraulic control valve of claim 8 further including a pressure relief valve positioned in a passageway connecting the supply port and the discharge port, the pressure relief valve being adapted to permit fluid flow from the supply port to the discharge port at a predetermined fluid pressure level.

12. The hydraulic control valve of claim 1 further including a pressure relief valve positioned in a passageway connecting the supply port and the discharge port, the pressure relief valve being adapted to permit fluid flow from the supply port to the discharge port at a predetermined fluid pressure level.

13. In combination (a) a hydraulic valve according to claim 1;

(b) a drive cylinder housing a hydraulically operable reciprocable piston, the piston controlling extension and retraction of a rod connected to the piston, the drive cylinder including a port connected to said delivery a port of the valve for effecting movement of said rod in one direction when said valve pin is in said first position, said rod being capable of movement in an opposite direction when said valve pin is in said second position; and (c) means for connecting the cylinder rod and said valve pin at predetermined rod extension and retraction positions, the rod and pin connecting means being capable of sliding the valve pin within the valve bore at said predetermined rod positions to said first and second pin positions.

14. The combination of claim 13 further including means for rotating said pin within said bore, wherein said pin groove extends only partly around the periphery of the pin leaving a pin surface control portion, the pin being rotatable to block the delivery port with the pin surface control portion.

15. The combination of claim 14 wherein the pin is rotatable to partially block the delivery port with the pin surface control portion and thereby control fluid passage through the delivery port.

16. The combination of claim 14 wherein the first and second contact fence members can be selectively positioned for contact with said valve pin at a plurality of cylinder rod extension and retraction positions.

17. The combination of claim 13 wherein the rod and pin connecting means comprises:

(a) a first contact fence member operably connected to said cylinder rod and connectable with said valve pin, wherein extension of said rod to a predetermined position connects the first fence member with the valve pin and causes the valve pin to slide within the valve bore between said first and second positions and thereby allow reversal of the direction of travel of said rod; and (b) a second contact fence member operably connected to said cylinder rod and connectable with said valve pin wherein retraction of said rod to a predetermined position connects the second fence member with the valve pin and causes the valve pin to slide within the valve bore between said second and said first pin positions to thereby reverse direction of travel of said rod.

18. The combination of claim 17 further including means for rotating said pin within said bore, wherein said pin groove extends only partly around the periphery of the pin leaving a pin surface control portion, the pin being rotatable to block the delivery port with the pin surface control portion.

19. The combination of claim 18 wherein the pin is rotatable to partially block the delivery port with the pin surface control portion and thereby control fluid passage through the delivery port.

20. The combination of claim 13 further comprising means connected to the valve pin for kinetically affecting sliding movement of said pin between said first and second positions.

21. The combination of claim 20 wherein the kinetic sliding means includes a handle extending generally perpendicular to the pin axis and connected to the pin at an end of the handle, the handle including a weighted member at another end of the handle, a portion of the handle comprising a spring connecting the weighted member with the pin allowing pivoting movement of the weighted member with respect to the pin, the combination including first and second handle-receivers on opposite sides of the weighted member, the handle-receivers and weighted member being arranged in a line parallel with the axis of the pin, the weighted member being magnetically attractable to a respective handle-receiver when brought into magnetically interacting proximity so that the weighted member and respective handle-receivers form magnetically interacting pairs, the weighted member being movable between the handle-receivers by sliding movement of said pin to bring the weighted member into magnetic interaction with a respective handle-receiver to kinetically assist sliding movement of the pin within the valve.

* * * * *

UNITED STATES PATENT AND TRADEMARK OFFICE

CERTIFICATE OF CORRECTION

PATENT NO. : 4,794,843

DATED : January 3, 1989

INVENTOR(S) : Denzil C. Poling

It is certified that error appears in the above-identified patent and that said Letters Patent is hereby corrected as shown below:

Column 1, line 37, after "further" insert -- including a --.

Signed and Sealed this

Twenty-third Day of January, 1990

*Attest:*

JEFFREY M. SAMUELS

*Attesting Officer* *Acting Commissioner of Patents and Trademarks*